US010543421B1

(12) United States Patent
Smith

(10) Patent No.: US 10,543,421 B1
(45) Date of Patent: Jan. 28, 2020

(54) GAME USING A DODECAHEDRON

(71) Applicant: Doug Smith, Jacksonville, FL (US)

(72) Inventor: Doug Smith, Jacksonville, FL (US)

( * ) Notice: Subject to any disclaimer, the term of this patent is extended or adjusted under 35 U.S.C. 154(b) by 0 days.

(21) Appl. No.: 16/269,985

(22) Filed: Feb. 7, 2019

(51) Int. Cl.
*A63F 9/06* (2006.01)
*A63F 9/08* (2006.01)

(52) U.S. Cl.
CPC ..... *A63F 9/0604* (2013.01); *A63F 9/0826* (2013.01)

(58) Field of Classification Search
CPC ..... A63F 9/0604; A63F 9/0826; A63F 2009/0849; A63F 2009/0853; A63F 9/12; A63F 9/1208
See application file for complete search history.

(56) References Cited

U.S. PATENT DOCUMENTS 4,416,453 A * 11/1983 Sasso ..... A63F 9/0838 273/153 S
4,500,090 A * 2/1985 Nieto ..... A63F 9/0838 273/153 S
4,558,866 A * 12/1985 Alford ..... A63F 9/0838 273/153 S
4,796,888 A * 1/1989 Louez ..... A63B 43/008 40/327
5,104,125 A * 4/1992 Wilson ..... A63F 9/12 273/157 R
5,411,262 A * 5/1995 Smith ..... A63F 9/12 273/156
6,116,979 A * 9/2000 Weber ..... A63F 9/1208 273/157 R
D606,807 S * 12/2009 Humphreys ..... D7/505
8,141,876 B2 * 3/2012 Humphreys ..... A63H 33/108 273/156
2009/0309302 A1 * 12/2009 Langin-Hooper ..... A63F 9/12 273/153 S
2010/0230897 A1 * 9/2010 Stott ..... A63F 9/0842 273/153 S

FOREIGN PATENT DOCUMENTS

DE 3125532 A1 * 2/1983 ..... A63F 9/0838
DE 3131654 A1 * 2/1983 ..... A63F 9/0838
DE 3134386 A1 * 3/1983 ..... A63F 9/0838
FR 2502021 A1 * 9/1982 ..... A63F 9/0838
FR 2515057 A1 * 4/1983 ..... A63F 9/0838
FR 2528712 A1 * 12/1983 ..... A63F 9/0838
FR 2667797 A1 * 4/1992 ..... A63F 9/0838
GB 2107595 A * 5/1983 ..... A63F 9/0838

* cited by examiner

*Primary Examiner* — Steven B Wong
(74) *Attorney, Agent, or Firm* — Lawrence J. Gibney

(57) ABSTRACT

The philosophy of games is to provide a mental challenge to the person who is playing the game. With this game a person can build the game according to that person's wants and desires and in this case a dodecahedron is used; the dodecahedron is color coded and an interior sphere is placed with the dodecahedron. Clues that have been placed in pockets of the outside surface of the dodecahedron will consist of locations where coins are hidden. These coins will be gathered and the dodecahedron is manipulated. The interior sphere contains the solution to the game or a prize and is initially locked prior to the start of the game. As the contestants play the game and "solve" the puzzle, the interior sphere is unlocked and the solution or prize is revealed. The game can be structured to the desires of the individual builder as often as possible.

2 Claims, 7 Drawing Sheets

PUZZLE KEY

KEY:

| COLORS | | | |
|---|---|---|---|
| RED | R | LIGHT RED | LTR |
| PURPLE | P | LIGHT PURPLE | LTP |
| BLUE | B | LIGHT BLUE | LTB |
| GREEN | G | LIGHT GREEN | LTG |
| YELLOW | Y | LIGHT YELLOW | LTY |
| ORANGE | O | LIGHT ORANGE | LTO |

| DIRECTIONS | |
|---|---|
| RIGHT | ▶ |
| LEFT | ◀ |

| EXAMPLE |
|---|
| 120 ▶ LTB |

| NUMBERS | DIRECTIONS | COLORS | NUMBERS | DIRECTIONS | COLORS | NUMBERS | DIRECTIONS | COLORS | NUMBERS | DIRECTIONS | COLORS |
|---|---|---|---|---|---|---|---|---|---|---|---|
| 1 | | | 31 | | | 61 | | | 91 | | |
| 2 | | | 32 | | | 62 | | | 92 | | |
| 3 | | | 33 | | | 63 | | | 93 | | |
| 4 | | | 34 | | | 64 | | | 94 | | |
| 5 | | | 35 | | | 65 | | | 95 | | |
| 6 | | | 36 | | | 66 | | | 96 | | |
| 7 | | | 37 | | | 67 | | | 97 | | |
| 8 | | | 38 | | | 68 | | | 98 | | |
| 9 | | | 39 | | | 69 | | | 99 | | |
| 10 | | | 40 | | | 70 | | | 100 | | |
| 11 | | | 41 | | | 71 | | | 101 | | |
| 12 | | | 42 | | | 72 | | | 102 | | |
| 13 | | | 43 | | | 73 | | | 103 | | |
| 14 | | | 44 | | | 74 | | | 104 | | |
| 15 | | | 45 | | | 75 | | | 105 | | |
| 16 | | | 46 | | | 76 | | | 106 | | |
| 17 | | | 47 | | | 77 | | | 107 | | |
| 18 | | | 48 | | | 78 | | | 108 | | |
| 19 | | | 49 | | | 79 | | | 109 | | |
| 20 | | | 50 | | | 80 | | | 110 | | |
| 21 | | | 51 | | | 81 | | | 111 | | |
| 22 | | | 52 | | | 82 | | | 112 | | |
| 23 | | | 53 | | | 83 | | | 113 | | |
| 24 | | | 54 | | | 84 | | | 114 | | |
| 25 | | | 55 | | | 85 | | | 115 | | |
| 26 | | | 56 | | | 86 | | | 116 | | |
| 27 | | | 57 | | | 87 | | | 117 | | |
| 28 | | | 58 | | | 88 | | | 118 | | |
| 29 | | | 59 | | | 89 | | | 119 | | |
| 30 | | | 60 | | | 90 | | | 120 | | |

FIG. 7

GAME USING A DODECAHEDRON

BACKGROUND OF THE INVENTION

A. Field of the Invention

This relates to playing a game involving the use of Dodecahedron (a 12-sided sphere). The builder of the game would insert clues into various pockets or inserts in the sphere as the sphere is being assembled. It is intended that the sphere can be built and rebuilt as often as desired or needed. The clues that have been placed in the pockets or inserts would lead an individual(s) to solve the puzzle. As each clue is compiled, different portion of the sphere are manipulated. The interior sphere will have a smaller sphere and has a locking mechanism and the solution to the puzzle. After the individual has gathered all the clues and manipulated the appropriate portions of the sphere, the inner sphere is unlocked and the prize(s) is revealed.

B. Prior Art

There are many prior art references to games in general and games that involve the use of ball or spheres. However, in this case the methods and steps that are used to play the game are unique.

BRIEF SUMMARY OF THE INVENTION

This is a game which involves the use of a dodecahedron Sphere (the main sphere), which is a 12-sided sphere. Within the interior of the main sphere will be a smaller, interior sphere. Attached to a portion of the main sphere will be anchors which will extend outward from the interior sphere. One of the anchors will be connected to a locking mechanism from the interior sphere.

An anchor top will be placed on the end of the anchor; this anchor top can be rotated by the person who plays the game and solves the puzzle. This will enable the interior sphere to be unlocked once the puzzle is solved.

The builder of the game will insert various clues in pockets which are on the outside surface of the dodecahedron (main sphere) as well as prizes that are contained in different portions of prize compartments.

These clues will lead an individual to various locations; the locations can be selected by the individual and the number of locations is infinite. Once the individual opens a pocket and selects a location the person will then go to that location to find a two-sided coin. On one side of the coin will be a figure that is color coded to correspond to the colors that are found on the sphere. On the opposite side of the coin will be directions that will be used once all the coins are collected. Each side of the dodecahedron will be color coded and the color of the coin will correspond to the respective color on the side of the dodecahedron.

After all the coins are collected, the coins are then placed on a chart, which has been provided by the game builder. On one side of the coin will be instructions on the terms of the order of play as well as the direction that the anchor top is to be turned. For instance one side of the coin may have the following instruction: "8-R", which would mean that on the $8^{th}$ rotation of the anchor top the rotation of the anchor top would be to the right. There will be ten coins per side and each coin in that section will be color coded. In total there will be 120 coins. On each coin it will have a number from one to ten or one to one hundred and twenty (builder's choice) which indicates the order of play and direction either to the right or left. On each coin it will have a number from one to ten, or 1-120 coins, builder's choice, which indicates the order of play and directions either to the right or left.

After all 120 coins have been collected and arranged on the chart, the anchor tops will then be rotated according to the directions that have been provided. After all 120 moves have been made the anchor lock on the interior sphere will unlock and reveal the solution to the game and reveal the prize.

The game is played by a person or persons and a team concept is also contemplated who handle the device based on the desires of the builder. In that fashion the builder can arrange and rearrange the dodecahedron as often as possible.

The dodecahedron is scrambled before any coins are collected and there are 10-120 coins (although 10 would invoke the user to buy more coins) that come with the game with 10 coins per side using 12 colors. New coins could be hidden inside. There will be different colors for each respective section.

Within the interior, there will be prize pieces which are placed to reveal various prizes when the game is completed.

BRIEF DESCRIPTION OF THE DRAWINGS

FIG. 7 is a depiction of the chart.

NUMBERING DESCRIPTION

Figure 1:
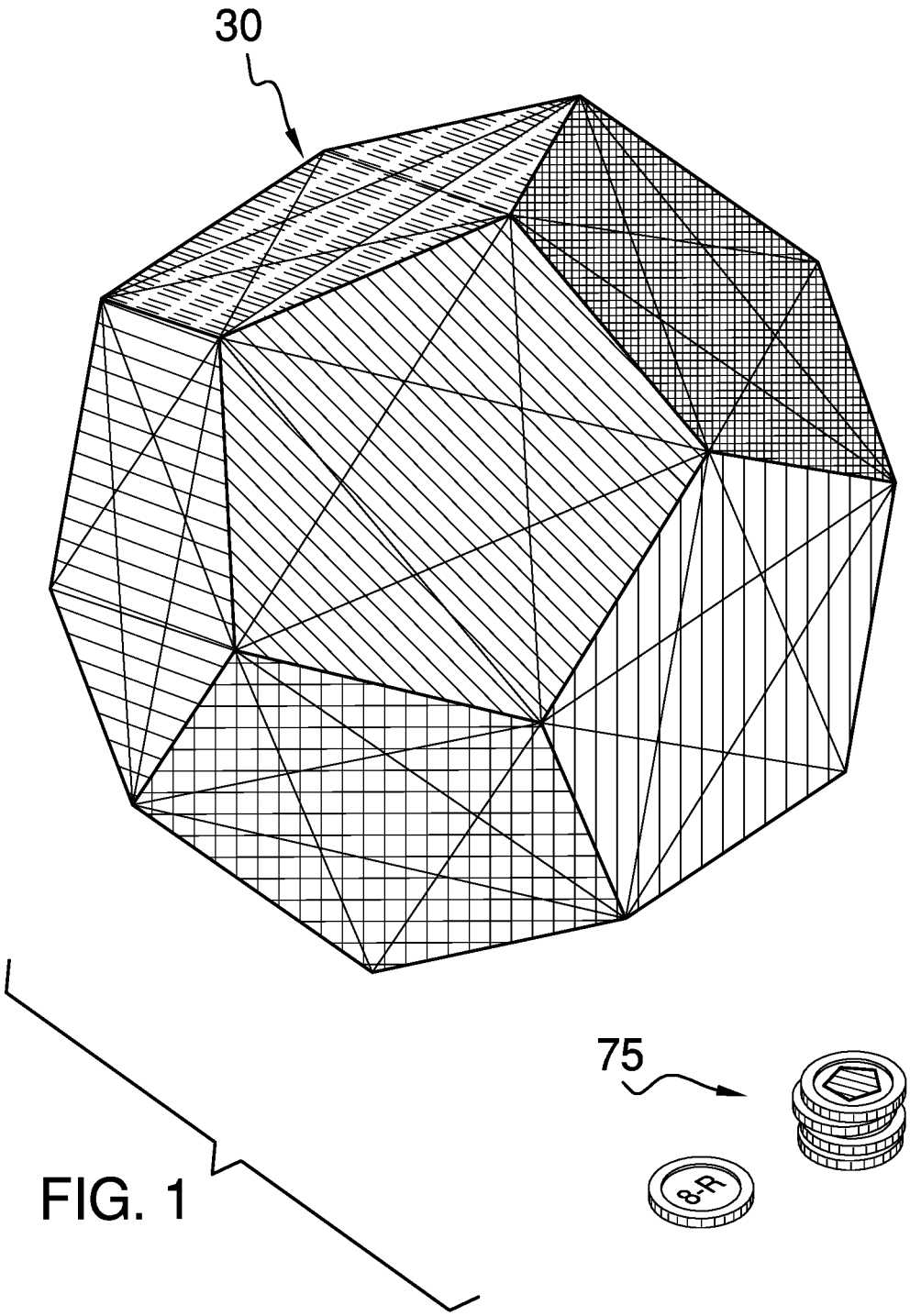
FIG. 1 is an isometric view of the dodecahedron with hatching lines to indicate different colors and the coins that indicate the direction on one side and the color on the opposite side.

5—Inner sphere
30—Dodecahedron (main sphere)
35—Keystone piece
50—Pentagon Tile
55—Stem
60S—Opening on Sphere for Stem
60T—Opening on pentagon tile for Stem
65—Spring
75—Coins
80—Internal Prize Piece

DETAILED DESCRIPTION OF THE EMBODIMENTS

This is a game that will be played an individual but can also be played by a team or teams. A dodecahedron (a 12 sided sphere or main sphere) 30 is assembled by a builder depending on the individual builder's tastes. The dodecahedron is then scrambled by the builder.

A plurality of keystone pieces 35 are provided that connect the sides of the dodecahedron; this permits the sphere to retain its shape during the playing of the game. Within the interior of the dodecahedron will be a plurality of prize pieces (not depicted) that will enable the player to gather various prizes as determined by the builder.

On each of the top surfaces of the dodecahedron 30 a pentagon top 50 will be in the center of the respective side. A plurality of keystone pieces 35 will abut the other keystone pieces. Clues are inserted inside the various keystone pieces 35 which are located on the top surface of the dodecahedron 30 and abut the pentagon tile 60.

These clues would typically be locations which will direct the individual who is playing the game to solve the puzzle to coins 75 that are two sided. One side of the coin will be color coded to correspond with the color of the side of dodecahedron. On the opposite side of the coin will be a number as well as the letter "L" or "R" to indicate a direction. The "L" or "R" would indicate that the anchor top would be moved either to the left or right when all the coins are assembled.

Figure 2:
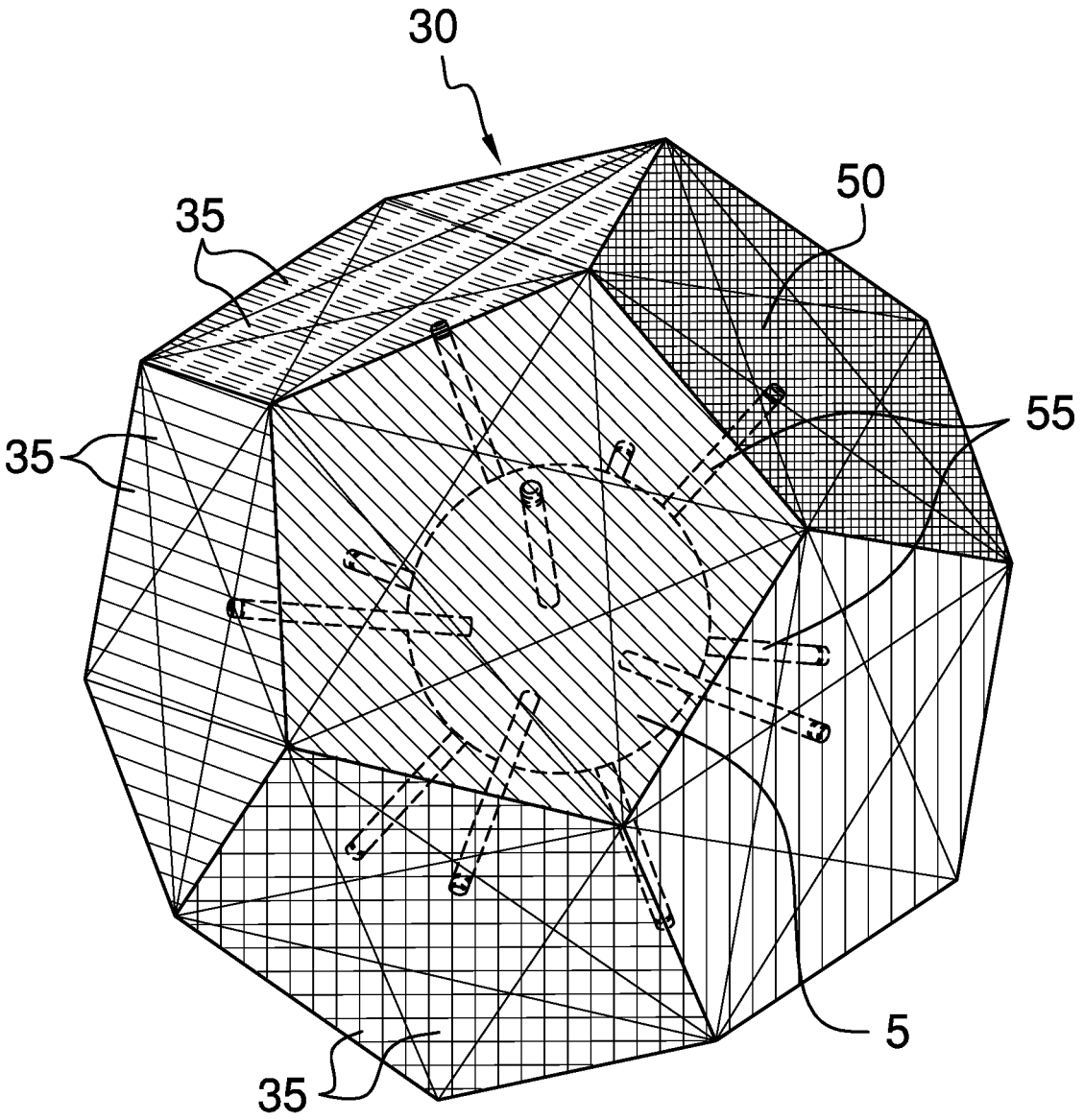
FIG. 2 is an isometric view of the dodecahedron with hatching lines to indicate different colors and the interior sphere with the stems.

Each of the sides of the dodecahedron 30 are color coded. The different color codes are represented by the hatching in FIGS. 1 and 2. It is anticipated that some of the colors of each of the sides will be primary colors and other will be secondary colors.

There are 120 color-coded coins 75, ten for each side of the dodecahedron involved in the game and these coins once they have been assembled would then be placed on a chart as depicted in FIG. 7 where each coin would also have a color that corresponds to the color of the corresponding dodecahedron side(s). Once all the coins have been collected the coins are arranged on the chart from 1-10 or 1-120 per color in consecutive order.

This arrangement of the coins on the chart will then permit the puzzle to be solved depending on the directions on the coins. For instance, one of the sides of the dodecahedron may be the color red. Each of the ten red coins are arranged on the chart from 1-10 and the player would then start with the first number and rotate the red anchor top one notch, either to the left or to the right. The player would then move to the second red coin and repeat this sequence until all ten coins have been used. The person would then move to the second color according to the directions of the game. Once all the coins have been used the puzzle or game would be solved when the interior sphere is unlocked.

As each of the respective pentagon tiles 60 are rotated the mechanism that will unlock the interior sphere 5 is closer to being opened. The game is complete when the interior sphere 5 is unlocked.

Figure 3:
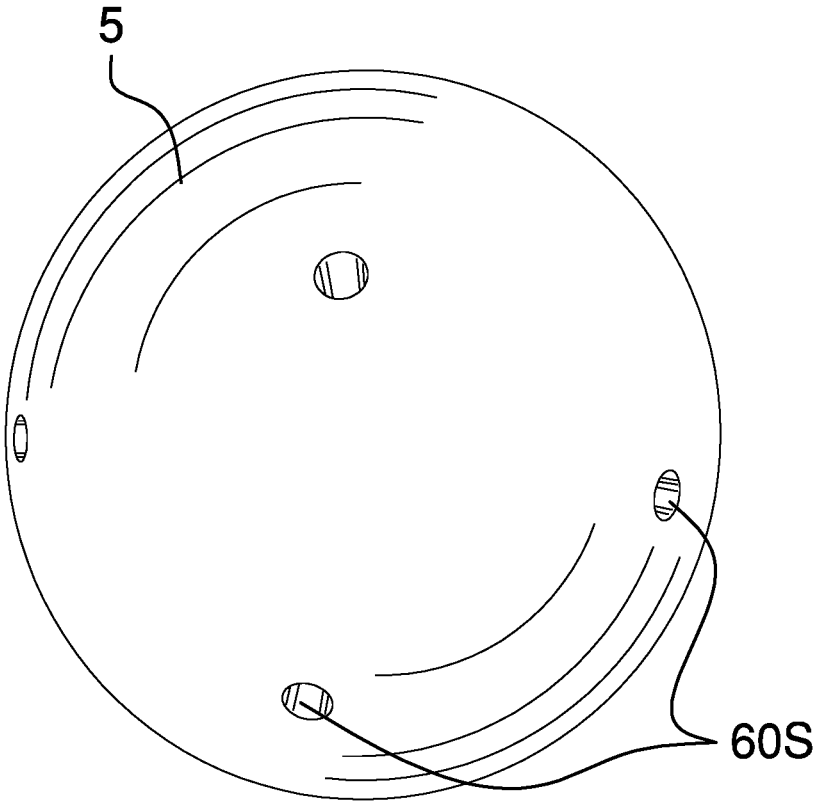
FIG. 3 is an isometric view of the inner sphere.
Figure 4:
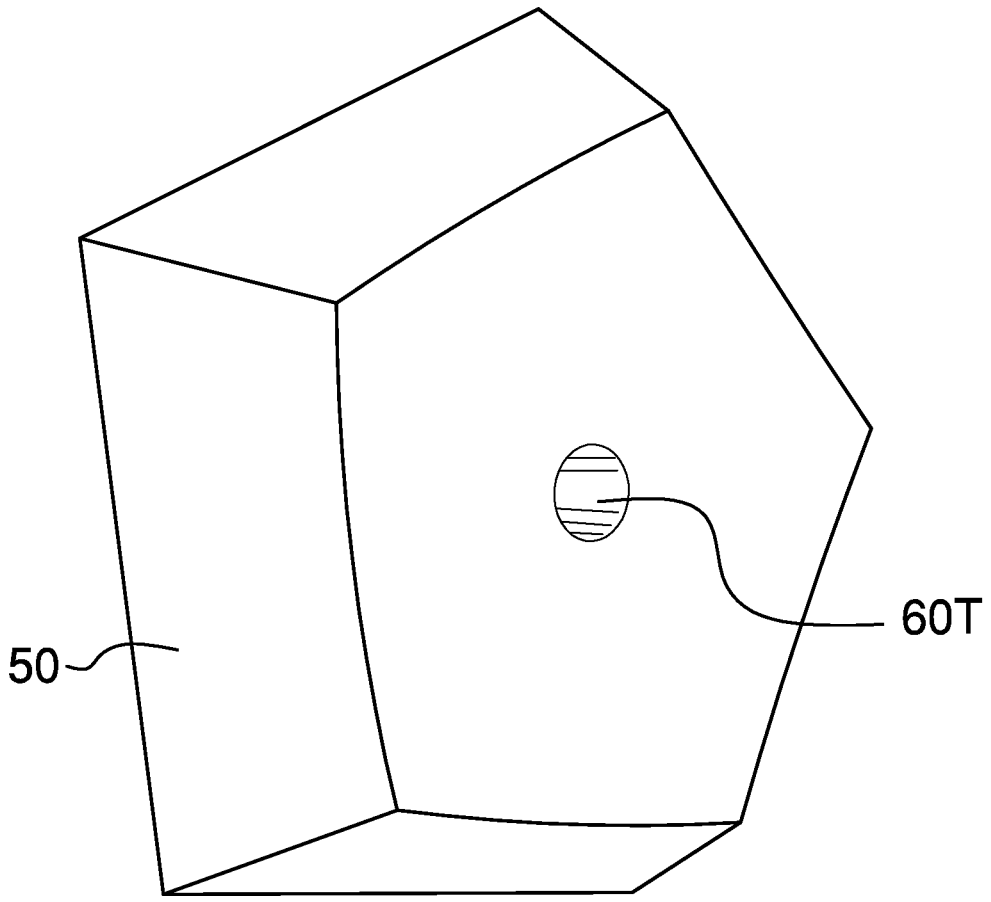
FIG. 4 is a detail view of the anchor.
Figure 5:
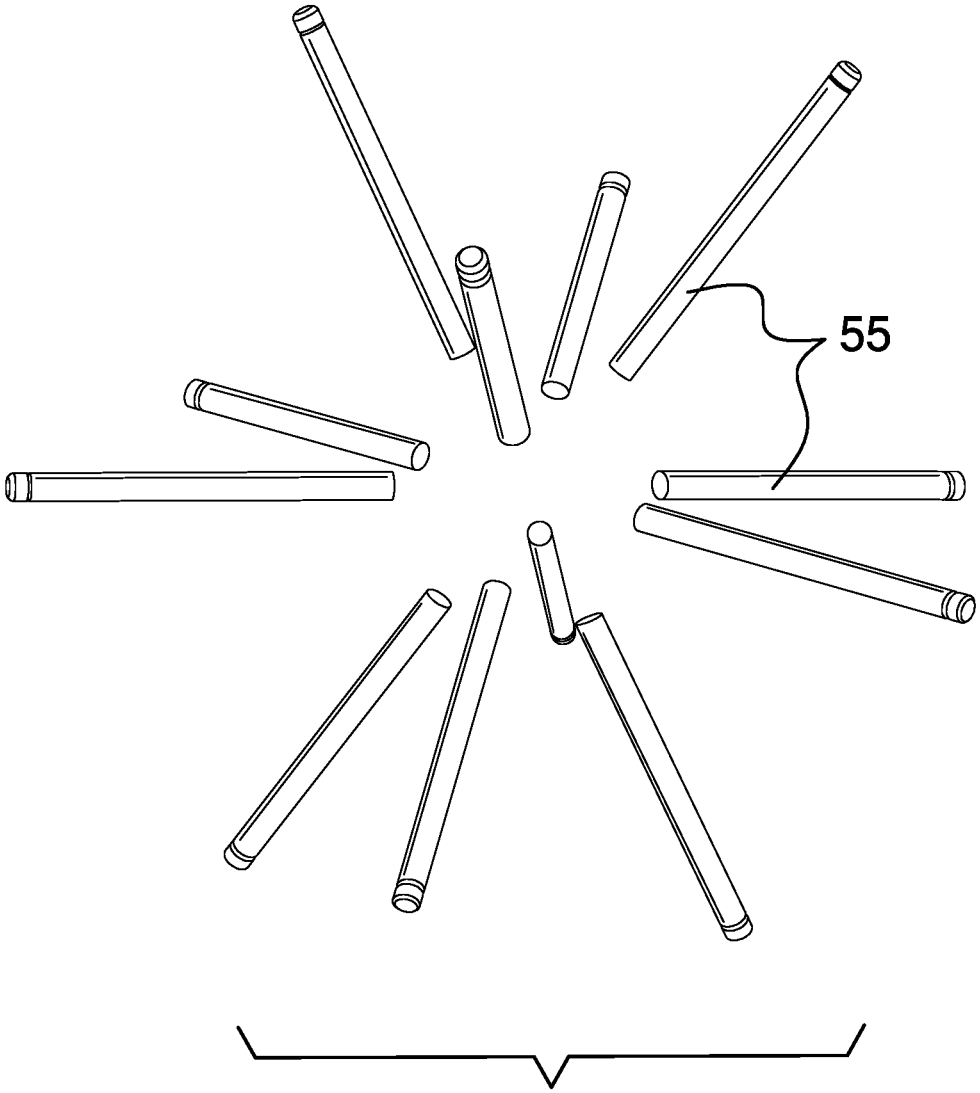
FIG. 5 is a detail view of the stem array.
Figure 6:
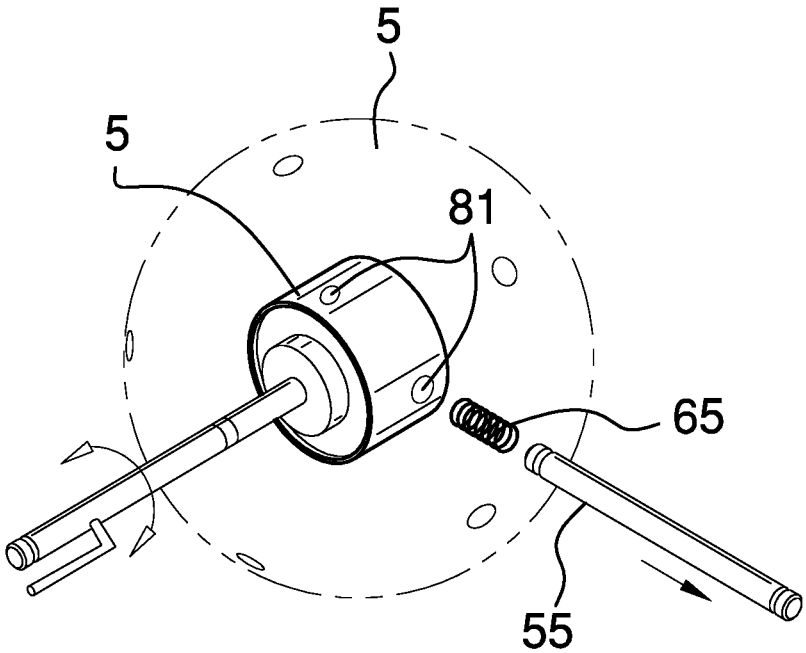
FIG. 6 is an isometric view of the internal prize piece.

A plurality of openings 60 are provided on the sphere as depicted in FIG. 3. An opening 60T is provided on the underside of each of the pentagon tiles. A plurality of stems 55 connect the sphere and the pentagon tiles 50. Within the sphere is an internal prize piece 80. Each of the stems are inserted through the opening in the sphere 60S into cavities 81 in the internal prize piece 80. A spring 65 is placed in the cavities of the internal prize piece such as depicted in FIG. 6.

Within the interior sphere 5, there will be a locking mechanism that is initially set by the builder. Within the interior sphere 5 will be a prize that is awarded to the first person who is able to unlock the interior sphere 5.

While the embodiments of the invention have been disclosed, certain modifications may be made by those skilled in the art to modify the invention without departing from the spirit of the invention.

The inventor claims:

1. A game to be played that is comprised of:
- a dodecahedron:
- wherein each side of the dodecahedron is color coded;
- the dodecahedron comprising:
  - a plurality of pentagon tiles;
  - an interior sphere;
  - said pentagon tiles are connected to the interior sphere;
  - a plurality of anchors;
  - said anchors connect the plurality of pentagon tiles to the interior sphere;
  - a plurality of keystone pieces;
  - wherein the plurality of keystone pieces are placed on each side of the dodecahedron;
  - wherein clues placed in each of the keystone pieces;
- a plurality of coins;
- said clues each directing the player(s) to a location of one of the plurality of coins;
- wherein the plurality of coins have a first side and a second side;
- wherein the first side of the plurality of coins has a color that corresponds to the color of the side of the dodecahedron;
- wherein the second side of the plurality of coins contains a number and a direction;
- a chart;
- wherein the chart contains all the colors of the sides of the dodecahedrons;
- wherein the chart permits the player to arrange the coins.

2. The device as described in claim 1 wherein there are ten coins per dodecahedron side.

* * * * *